United States Patent [19]

Lin

[11] 4,164,091

[45] Aug. 14, 1979

[54] BUILDING BLOCKS SET

[76] Inventor: Wen-ping Lin, 30, Chien-Yung St., Taichung, Taiwan

[21] Appl. No.: 891,717

[22] Filed: Mar. 30, 1978

[51] Int. Cl.[2] ..... A63H 33/04

[52] U.S. Cl. ..... 46/26; 46/16; 46/31

[58] Field of Search ..... 46/16–31; 35/27, 34, 72, 69, 28

[56] References Cited

U.S. PATENT DOCUMENTS

| | | | |
|---|---|---|---|
| 3,442,044 | 5/1969 | Quercetti | 46/25 X |
| 3,589,056 | 6/1971 | Glass et al. | 46/16 |
| 3,594,940 | 7/1971 | Yonezawa | 46/23 X |
| 4,074,496 | 2/1978 | Fischer | 46/31 |

FOREIGN PATENT DOCUMENTS

| | | | |
|---|---|---|---|
| 1258316 | 1/1968 | Fed. Rep. of Germany | 46/31 |

*Primary Examiner*—John F. Pitrelli

*Attorney, Agent, or Firm*—Miller & Prestia

[57] ABSTRACT

A set of building blocks is used for educational aid as well as decoration and readily assembled to form a tree-like structure, which comprises several building elements adapted to be coupled by plug and socket connectors to form a trunk as well as branching portion of a tree-like structure, and several base boards which can be connected side by side to construct a base as a ground member of the tree-like structure.

2 Claims, 4 Drawing Figures

BUILDING BLOCKS SET

BACKGROUND OF THE INVENTION

Many known types of building blocks have been developed in the art, but no conventional sets of building blocks can be used to build decorative tree-like structures and can be built readily a new form. The usual base boards of the known building blocks set are limited in structure to combine themselves only face to face not side by side, therefore, the number of ways of construct a structure is considerably restricted.

SUMMARY OF THE INVENTION

This invention relates to a set of building blocks which is particularly, but not exclusively used to construct a tree-like structure on a ground member for educational aid and decorative object.

It is an object of the present invention to provide a set of building blocks which can be readily assembled to form a tree-like structure built on a ground member.

Another object of the present invention is to provide several building elements to construct various shapes of tree-like structures.

A further object of the present invention is to provide several base boards, each base board is provided with a multiplicity of protrusion and socket elements therein by which the building elements are coupled to the base boards to build the tree-like structure, and several semi-annular recesses transversely countersunk into and around the edge thereof, whereby the base boards can be readily coupled to each other side by side by suitable connectors.

This set of building blocks enables a child to build constructions on a ground member comprising more than one base boards, there are a variety of shapes may be built.

BRIEF DESCRIPTION OF THE DRAWINGS

The present invention will be hereinafter particularly described with reference to the accompanying drawings wherein.

Figure 1:
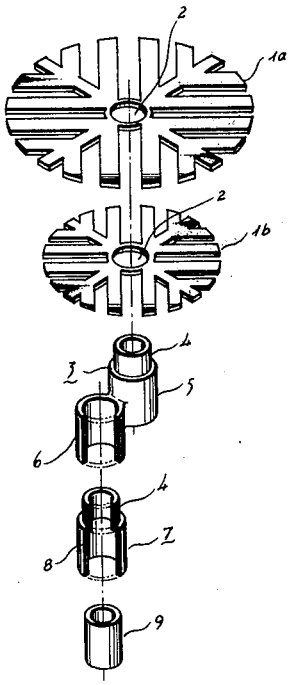
FIG. 1 is a perspective and fragmental view showing several building elements used to construct the tree-like structure according to the invention.

A set of building elements as shown in FIG. 1 comprises branching elements 1*a* and 1*b* having a central hole 2 therein respectively, the latter has a smaller size, a hollow twin plug and socket member 3 whose right part is stepped so as to form a plug portion 4 and a socket portion 5 which is integrally attached to the left lower socket portion 6, a single plug and socket member 7 is stepped so as to have a plug 4 and a socket 8, and a hollow cylindrical connector 9. The connector 9 and plug 4 are so dimensioned to tightly engage into the hole 2 and sockets 5, 6 and 8 which have the same inner diameter, thereby said twin member 3 and single member 7 can cooperate with the branching elements 1*a*, 1*b* and connector 9 to build a tree-like structure as shown in FIG. 4 by the tight engagement between said plugs, sockets and connectors.

Figure 2:
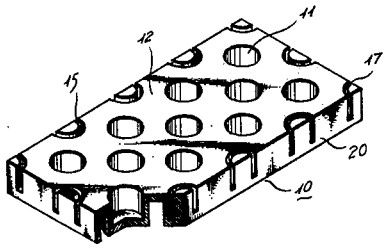
FIG. 2 is a perspective and fragmental top view showing a rectangular base board according to the invention.
Figure 3:
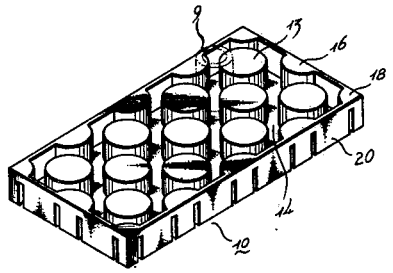
FIG. 3 is a perspective bottom view showing a rectangular base board according to the invention.

Referring to FIGS. 2 and 3, a rectangular base board 10 according to the present invention as shown comprises a plurality of socket-recesses 11 spaced from each other and countersunk into the board from the top surface 12 (FIG. 2), each said socket recess is coaxial with the cylindrical protrusion 13 extending from the bottom surface 14 of the board (FIG. 3), several semi-annular flutes 15 transversely countersunk into the board from the top surface 12 thereof and cut through and along the side walls 20 thereof, each said flute 15 is coaxial with a semi-annular protrusion 16 extending from the bottom surface 14 of said board 10, and a quarter-annular flute 17 countersunk into each corner portion of the board 10 and cut through adjacent side walls, each quarter-annular flute 17 is coaxial with a quarter-annular protrusion 18 extending from said bottom surface.

The socket-recesses 11 are also dimensioned to tightly fit said plug 4 and connector 9, said flutes 15 and 17 have been countersunk into the top surface of said board, the depth of which is generally equal to half length of said plug 4 which is equal to half length of said connector 9. The protrusions 13, 16 and 18 are spaced in suitable arrangement that said plug 4 or connector 9 can be individually engaged therebetween thereby a tree-like structure may also be built on the bottom surface of said boards.

Figure 4:
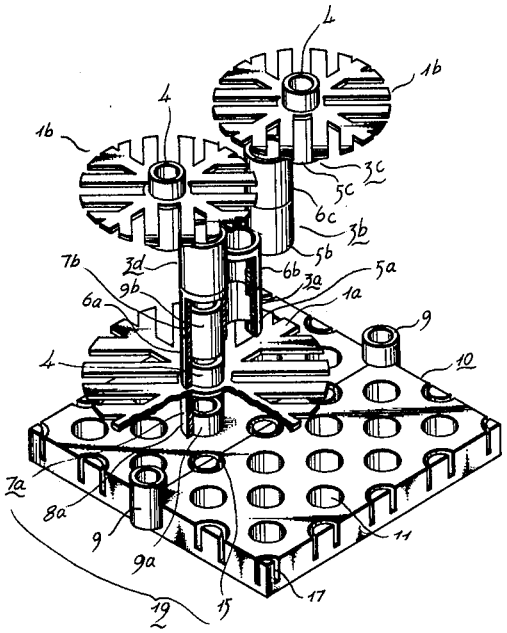
FIG. 4 is a perspective and fragmental view showing a tree-like structure built on ground member combined by two base boards according to the invention.

While two boards 10 are disposed side by side as shown in FIG. 4, the flutes 15 and 17 of the first board will cooperate with the corresponding flutes 15 and 17 of the second board so as to form annular-recesses and semi-annular recesses respectively thereby the boards can be connected side by side by engaging said connectors 9 into the annular-recesses or semi-annular recesses. In a similar way, a plurality of boards 10 may also be combined as a gound member for a tree-like structure.

Referring now to FIG. 4, by way of example, two based boards 10 are connected together by the above-mentioned way to construct a ground member 19 having a tree-like structure thereon which is constructed in a way illustrated hereinafter. At first, put the lower portion of a first connector 9*a* into a socket-recess 11 of the ground assembly 19, and the upper portion of the first connector 9*a* is fit into the socket portion 8*a* of a first single member 7*a*, and, then fit plug 4 of the first single member 7*a* through the central hole of a branching element 1*a* and into the left socket portion 6*a* of a first twin member 3*a*. Plug 4 of the first twin member is fit into the left socket 6*b* of a second twin member 3*b*, and the upper portion of the left socket 6*a* of said first twin member 3*a* is engaged axially with the socket of a second single member 7*b* by engaging a second connector 9*b* therebetween.

Said second twin member 3*b* again has the plug 4 thereof engage within the lower left socket portion 6*c* of a third twin member 3*c*, the plug 4 of said third twin member 3*c* is journalled in a branching element 1*b*. Furthermore, the plug of said second single member 7*b* is journalled in the lower socket portion of a fourth twin member 3*d*, the plug 4 of said fourth twin member 3*d* is also journalled in a second branching element 1*b*, thus, a tree-like structure is completely finished and built on the ground assembly 19.

The connection and engagement between said twin and single members, branching elements, connectors and ground assembly is changable except what is shown and described hereinabove, therefore, a variety of shapes of tree-like structures may be constructed accordingly.

As the building blocks described hereinabove are readily assembled to form various shapes of tree-like structures, a child can be thus trained to use and enlarge his imagination by the aid of the building blocks according to the present invention. In addition to this, the changeable nature of the tree-like structure has very great novelty and decorative value, the building blocks set will also be popular for recreation.

What is claimed is:

1. A set of building blocks comprises a plurality of building elements including branching elements having a central hole therein, a twin plug and socket member, a single hollow pluug and socket member, and a cylindrical connector; and several base boards having a plurality of socket-recesses countersunk into the top surface thereof and protrusions extending from the bottom surface thereof, wherein said base boards are provided with several semi-annular recesses countersunk into the side walls of the top surface thereof so as to form correspondingly semi-annular protrusions extending from edges of the bottom surface thereof, and provided with four quarter-annular recesses countersunk respectively into each corner of the top surface thereof so as to form correspondingly four quarter-annular protrusions extending from corners of the bottom surface thereof, whereby the semi-annular recesses and the quarter-annular recesses of different base boards can cooperate each other to define suitable recess combinations, said cylindrical connector can be engaged into the recess combinations so as to couple said base boards side by side.

2. A set of building blocks according to claim 1, wherein said twin plug and socket member has a right portion having an upper stepped portion whose outer diameter is smaller than the inner diameter of the central hole of said branching element, and a left socket portion which is integrally attached to the lower portion of the right portion.

* * * * *